US005809713A

United States Patent [19]

Ray

[11] Patent Number: 5,809,713

[45] Date of Patent: Sep. 22, 1998

[54] STRUCTURAL ELEMENTS

[75] Inventor: Brian Thomas Ray, City Beach, Australia

[73] Assignee: Lancefield Pty Ltd., City Beach, Australia

[21] Appl. No.: 645,353

[22] Filed: May 13, 1996

[51] Int. Cl.[6] ..... E04C 5/08

[52] U.S. Cl. ..... 52/223.9; 52/223.7; 52/223.8

[58] Field of Search ..... 52/223.1, 223.4, 52/223.8, 223.9, 223.14, 737.3, 223.5, 223.7, 726.1, 433, 439, 726.2, 726.3, 726.4, 223.11, 223.12, 223.13, 724.3, 73

[56] References Cited

U.S. PATENT DOCUMENTS

| | | | |
|---|---|---|---|
| 1,176,366 | 3/1916 | Ickes | 52/223.1 X |
| 1,504,816 | 8/1924 | Cummings | 52/433 |
| 2,075,633 | 3/1937 | Anderegg | 52/223.9 |
| 2,645,115 | 7/1953 | Abeles | 52/223.9 |
| 3,251,162 | 5/1966 | Strimple | 52/223.8 |
| 4,007,574 | 2/1977 | Riddell | 52/722 |
| 4,069,638 | 1/1978 | Hasselqvist et al. | 52/726.2 |
| 4,081,935 | 4/1978 | Wise | 52/726.2 X |
| 4,615,163 | 10/1986 | Curtis et al. | 52/737.3 |
| 4,718,965 | 1/1988 | Finsterwalder et al. | 52/223.14 X |
| 4,850,172 | 7/1989 | Gailey et al. | 52/726.2 X |
| 4,932,178 | 6/1990 | Mozingo | 51/223.7 |
| 5,097,558 | 3/1992 | Accorsi et al. | 52/223.1 |
| 5,540,030 | 7/1996 | Morrow | 52/223.1 X |

FOREIGN PATENT DOCUMENTS

| | | |
|---|---|---|
| 20/16714 | 10/1920 | Australia . |
| 53/21770 | 12/1953 | Australia . |
| 72/457091 | 1/1975 | Australia . |
| 90/50391 | 8/1990 | Australia . |
| 243176 | 10/1987 | European Pat. Off. . |
| 1050836 | 1/1954 | France . |
| 100788 | 4/1937 | United Kingdom . |

OTHER PUBLICATIONS

Patent Abstracts of Japan, M–1115, p. 32, as it relates to JP–A–3–51461 (Kunio Honma).

*Primary Examiner*—Beth A. Aubrey
*Attorney, Agent, or Firm*—Kerkam, Stowell, Kondracki & Clarke; Dennis P. Clarke

[57] ABSTRACT

A structural beam (10,20) including a plurality of transversely extending discrete timber pieces (12) arranged in alignment, each timber piece (12) having opposed parallel faces which abut with equivalent faces of adjacent pieces, aligned apertures being formed in the pieces and a longitudinally extending prestressing cable (14) passing through the aligned apertures under tension so as to press the aligned pieces together.

7 Claims, 11 Drawing Sheets

STRUCTURAL ELEMENTS

FIELD OF THE INVENTION

The present invention relates to structural elements.

SUMMARY OF THE INVENTION

In accordance with one aspect of the present invention there is provided a structural beam comprising a plurality of transversely extending discrete timber pieces arranged in alignment, each timber piece having opposed transversely extending parallel faces which abut with equivalent faces of adjacent pieces, a respective bearing plate at each end of the beam, an aperture formed in each piece such that the respective apertures in the beam are aligned and a longitudinally extending prestressing cable passes through the aligned apertures and is anchored on the bearing plates under tension so as to press the aligned pieces together with the transversely extending parallel faces in abutting relation with equivalent faces of adjacent pieces.

BRIEF DESCRIPTION OF THE DRAWINGS

The present invention will now be described, by way of example, with reference to the accompanying drawings, in which.

DETAILED DESCRIPTION OF THE INVENTION

Figure 1:
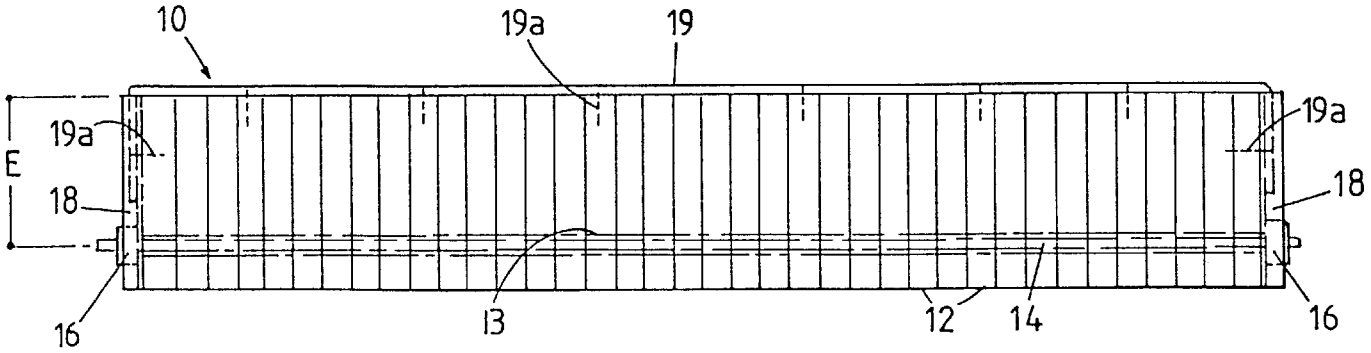
FIG. 1 is a side elevation of a structural beam in accordance with the present invention.
Figure 2:
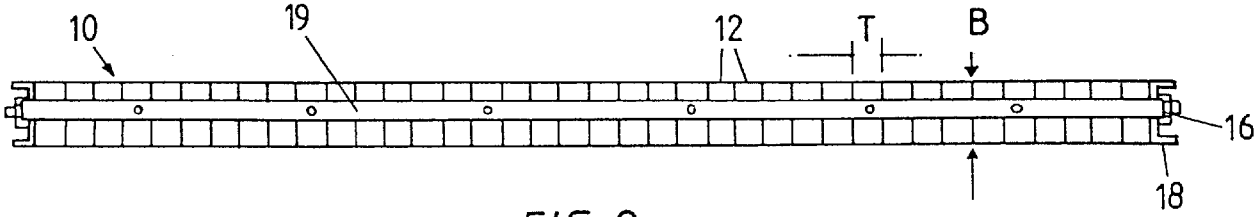
FIG. 2 is a plan view of the beam of FIG. 1.
Figure 3:
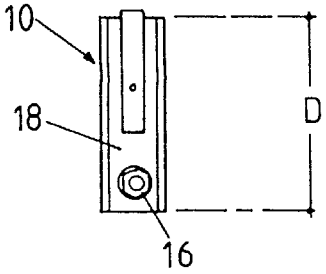
FIG. 3 is an end view of the beam of FIG. 1.

In FIGS. 1 to 3 of the accompanying drawings, there is shown a prestressed timber segment structural beam 10. The beam 10 is formed from a plurality of transversely extending relatively short pieces 12 of timber such as waste off-cuts of low value having a length D (see FIG. 3). The timber pieces 12 are assembled face to face with their respective relatively long faces contiguous to and abutting similar faces of adjacent pieces 12.

The pieces 12 are all of similar length D and of similar width B as can be seen in FIG. 2. Further, each piece 12 is of generally similar thickness T. The pieces 12 do not have to be of the same thickness but for the beam 10 to be linear, the abutting faces of each piece 12 do need to be substantially parallel.

Each timber piece 12 is formed with a hole 13 such as by drilling and the holes 13 of the pieces 12 are aligned in the beam 10 when the pieces 12 are placed in abutting relation. A prestressing cable 14 which may be made of steel is passed through the aligned holes from end to end of the beam 10.

The prestressing cable 14 can be of any convenient form such as a rod, wire, strand or cable. The cable 14 is anchored against the ends of the beam 10 by means of anchors 16 which press against bearing plates 18. The beating plates 18 can take the form of U-shaped plates as shown in FIGS. 1 to 3, or flat plates or rolled hollow section bearing plates provided with access apertures for the anchors 16, or any other convenient form. In use, the pieces 12 are placed between the bearing plates 18 and the cable 14 is passed through the aligned holes. The anchors 16 are then mounted to the cable 14 in abutting relation with the bearing plates 18 so as to press against the bearing plates 18. The cable 14 is then tensioned such as by means of an hydraulic jack and attached to the anchors 16, in known manner. The timber may be subject to loss of dimension because of shrinkage due to loss of moisture below fibre saturation point and creep. Therefore, it is preferred to use seasoned or dry timber having a moisture content of less than 15% by weight because this is less than fibre saturation point which is about 30% by weight but above equilibrium moisture content which is about 12% by weight in many climates. The steel used in the cable 14 is generally of a high strength and low relaxation material. The bearing plates 18 generally are such as to be able to transfer force to the structure at acceptable pressure. The anchors 16 are generally such as to be able to hold the cable 14 after stressing.

The distance from the top of the beam 10 to the centre of the cable 14 is E as shown in FIG. 1. For the beam 10, the distance E is preferably greater than D/2. With the beam shown in FIGS. 1 to 3, bending compression about the major axis in the upper areas of the beam is accommodated by cross grain compression strength within the timber and at the inter faces between the pieces 12.

Further, bending tension about the major axis in the lower areas is accommodated by the composite action of the cable and the timber. This participation in bending tension is a primary function of the cable 14.

Another function of the prestressing cable 14 is to sustain force across the faces of the timber pieces 12 such that interfacial friction between the pieces 12 is able to transmit vertical shear in the beams in the longitudinal direction.

In most working situations adhesive does not need to be applied to the interfaces of the timber pieces 12 to assist transmission of vertical shear.

The relatively low moisture content reduces the creep in the timber pieces 12 under compression and long term load does not lead to significant loss of tension in the cable which would impair the beam characteristics.

In connection with the beam of FIGS. 1 to 3, it has been found that cross-grain timber , especially softwood, is very compressible compared to parallel-grain timber. This characteristic of compressibility is measured as the ratio of stress to strain and is called Modulus of Elasticity (E). E for dry dressed pine parallel to the grain may be 6900but across the grain may be only 150–200.

As shown in FIGS. 1 to 3, it is possible to affix metal strapping 19 such as hoop iron strapping, to the ends of the beam 10 by bending over the ends of the strapping 19 and nailing the bent over ends to the beam 10 by means of nails 19*a*. Also, the strapping 19 can be nailed at intervals along its length to the top of the beam 10 by means of nails 19*a*. The provision of the strapping 19 reduces upward pre-camber during stressing of the single cable 14 located towards the lower end of the beam.

Figure 4:
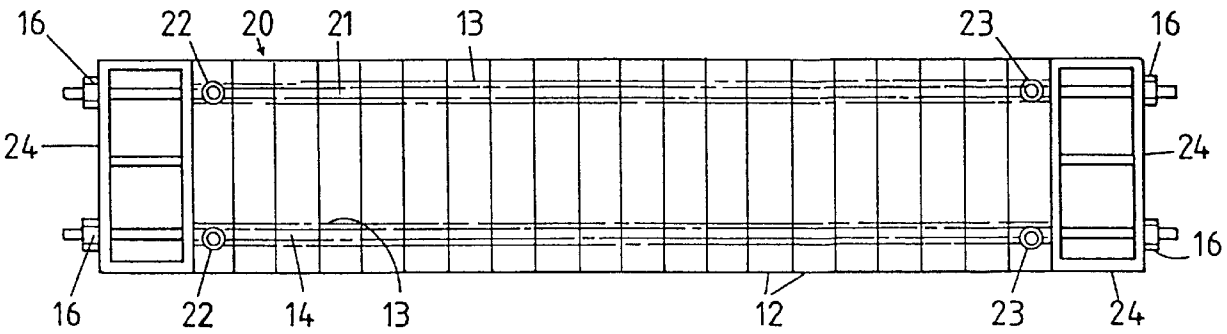
FIG. 4 is a side elevation of a structural beam in accordance with a further embodiment of the present invention.
Figure 5:
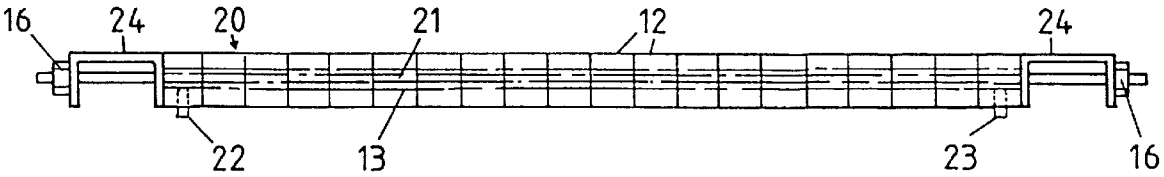
FIG. 5 is a plan view of the beam of FIG. 4.

In FIGS. 4 and 5 of the accompanying drawings, there is shown a structural beam 20 which is similar to that shown in FIGS. 1 to 3 and like reference numerals denote like parts.

However, in addition to the lower cable 14 there is also provided an upper cable 21 which mirror images the lower cable 14. The addition of the upper cable 21 controls pre-camber and increases the stiffness of the beam 20.

Thus, a tensioned cable 21 is being introduced into the compression zone of a simply supported beam in bending. The improvement in stiffness is attributable to high compression deformation of the timber caused by the pre-stressing. In effect, some of the flexibility of the timber is being removed in the pre-stressing stage and before working loads are applied. The increased stiffening is achieved by locating at least two stressing cables each offset from the centreline of the beam 20. The cable 14 is located below the centreline by a particular distance and the cable 21 is located above the centreline by a similar distance. The relative distances from the centreline may vary depending on the prestress forces used and the beam design in general.

Further, as can be seen in FIGS. 4 and 5, the beam 20 is provided with inlets 22 for grout and outlets 23 for grout. The inlets 22 and the outlets 23 extend from the periphery to the beam 20 to the cables 14 and 21 and enable grout, such as epoxy resin or cement to be injected into the holes containing the cables 14 and 21 so that the cables 14 and 21 are held in place in the holes by the grout. Thus, for example, under load when the top cable 21 becomes de-stressed, it can, when grouted to the timber, begin to resist bending compression or reinforce the beam. Thus, under load grouting enhances the capacity and stiffness of the beam 20.

As seen in FIGS. 4 and 5, the beam 20 is provided with a steel channel anchorage 24 at each end. After grouting the anchorages 24 can be removed for reuse which lowers beam cost without altering the prestress significantly.

Grouting also has the advantage over an ungrouted beam in that if the ungrouted beam is inadvertently cut, beam failure might result. Also, the presence of the grout reduces corrosion of the cables.

The beam 20 of FIGS. 4 and 5 demonstrated an increase in stiffness relative to the beam of FIGS. 1 to 3, and a reduction in pre-camber. The beam of FIGS. 4 and 5 recovered substantially to its original configuration after removal of load.

In the structural beam of the present invention, it is important that the prestressing cables are offset vertically centreline of the beam to achieve improved stiffness in bending situations. The same applies to slabs to be described hereinafter, A centrally located cable has no influence on the stiffness of the beam in bending. With a centrally located cable, the stiffness of the beam is unaltered and remains that of wood. In a modification, the beam 20 of FIGS. 4 and 5 may be provided with cables 14 and 21 with significantly increased cross-sectional area which increases the stiffness of the beam over a wider range of loads.

Figure 6:
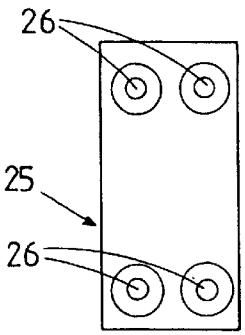
FIG. 6 is an end view of a first modification of the embodiment of FIGS. 4 and 5.

In FIG. 6, there is illustrated a variation on the beams of FIGS. 4 and 5, in which there is shown a beam 25 having two cables 26 in the top and two cables 26 in the bottom of the beam and equally offset from the centreline of the beam 25.

This arrangement may assist in controlling lateral straightness during prestressing and provides an increase in lateral stiffness.

Figure 7:
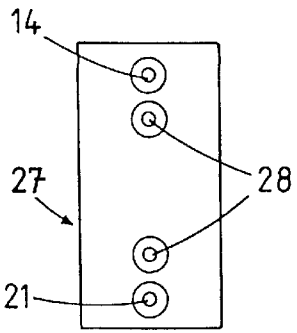
FIG. 7 is an end view of a second modification of the embodiment of FIGS. 4 and 5.

In FIG. 7, there is illustrated a beam 27 which is the same as the beam of FIGS. 4 and 5 except for the incorporation of unstressed steel bars 28 which are grouted to the timber so as to reinforce the beam and resist any tendency to creep. The unstressed steel bars 28 are installed before prestressing and are grouted after stressing of the prestressing cables.

Figure 8:
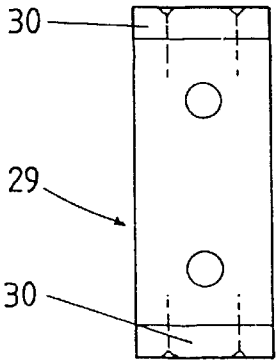
FIG. 8 is an end view of a third modification of the embodiment of FIGS. 4 and 5.

In FIG. 8, there is shown a further variation of the beam of FIGS. 4 and 5, in which a beam 29 is clamped in a straight position after fabrication by fixing a continuous member 30 such as by the use of nails or screws, to the top or bottom thereof or one or both sides. The continuous member 30 may be made of such material as wood, plywood or metal. This confers increased lateral straightness, bending capacity and stiffness on the beam 29.

Figure 9:
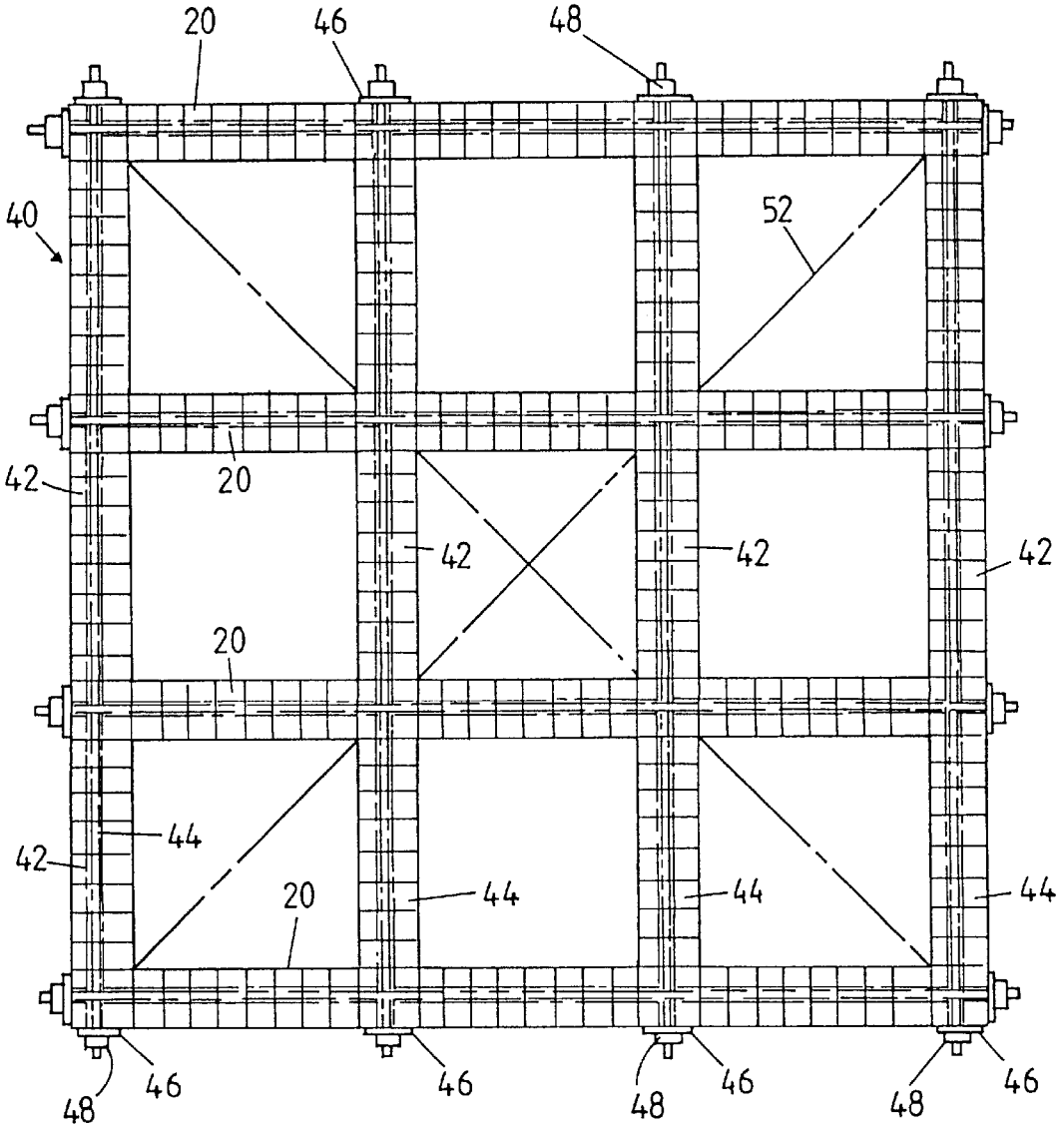
FIG. 9 is a plan view of a structural plate in accordance with the present invention.
Figure 10:
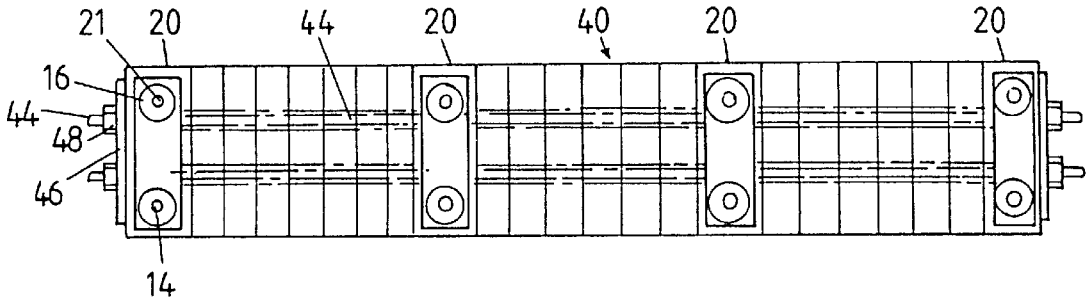
FIG. 10 is a side elevation of the plate of FIG. 9 from a first side.
Figure 11:
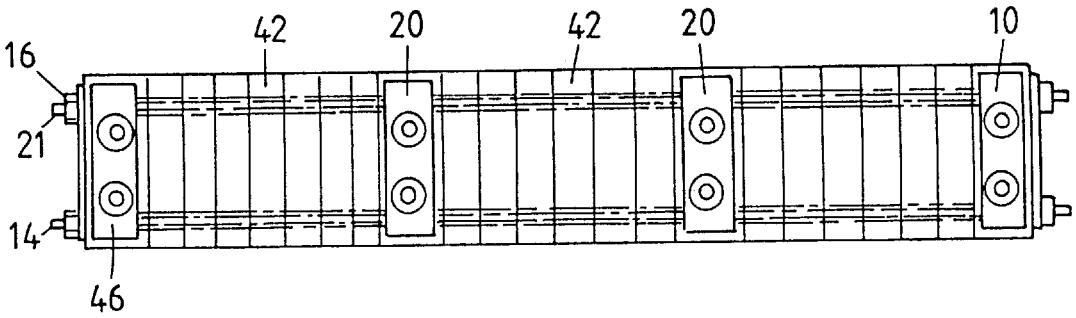
FIG. 11 is a side elevation of the plate of FIG. 9 from a second side.

In FIGS. 9 to 11, there is shown a structural plate 40. The plate 40 comprises a plurality of structural beams 20 which as shown in FIG. 9, extend longitudinally along the plate 40 parallel to one another.

In addition, the beams 20 are inter-connected at right angles by a series of timber segments 42 formed of timber pieces 12 disposed between the adjacent pairs of beams 20 and being prestressed by cables 44 anchored against sides of the outer beams 20 by means of bearing plates 46 and anchors 48. The cables 44 extend through aligned holes in the segments 42 and the beams 20. The beams 20 have an eccentricity of E as discussed above whereas the segments 42 have an eccentricity E which is less than E by at least 1.5 hole diameters to avoid interference of cables.

Thus, there is formed a cross grid of pre-stressed beams in which the top surfaces of all beams are in the same plane.

To ensure good square or rectangular shape, conventional beam cross-bracing 52 may be applied to the under side of the plate 40 extending diagonally from corner to corner as shown in FIG. 9.

It is intended that the plate 40 be lifted from or supported at the corners but because of the upper and lower cable arrangement, some limited flexibility in lifting or supporting positions exists.

The plate structure 40 shown in FIGS. 9 to 11, has an initial pre-camber and is very stiff. Thus, it is suitable for supporting large items sensitive to deflections such as houses including transportable houses during transport.

Figure 14:
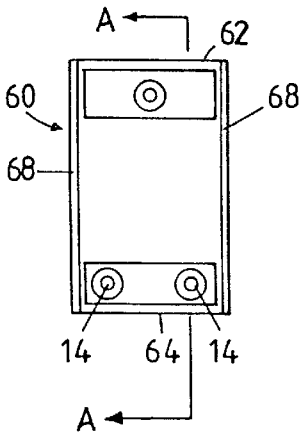
FIG. 14 is an end elevation of the beam of FIG. 12.
Figure 12:
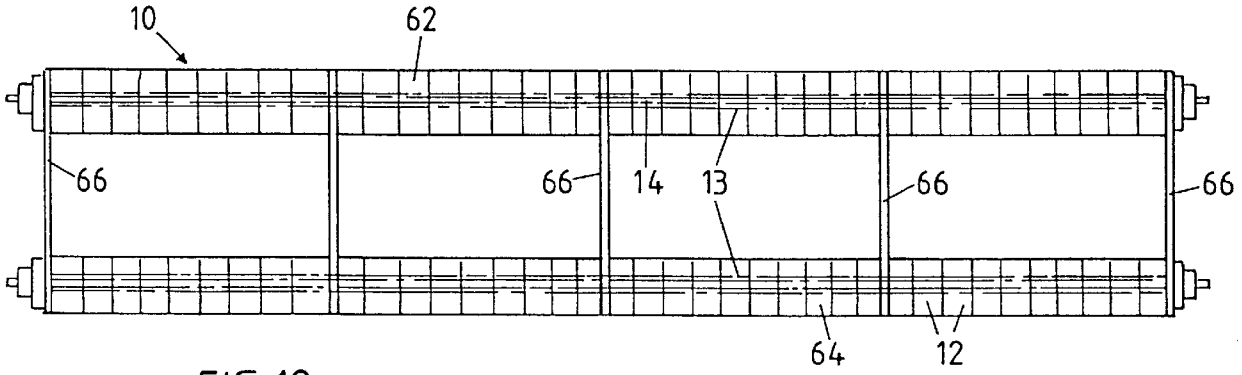
FIG. 12 is a sectional view along the line A—A of FIG. 14 of a structural box beam in accordance with the present invention.
Figure 13:
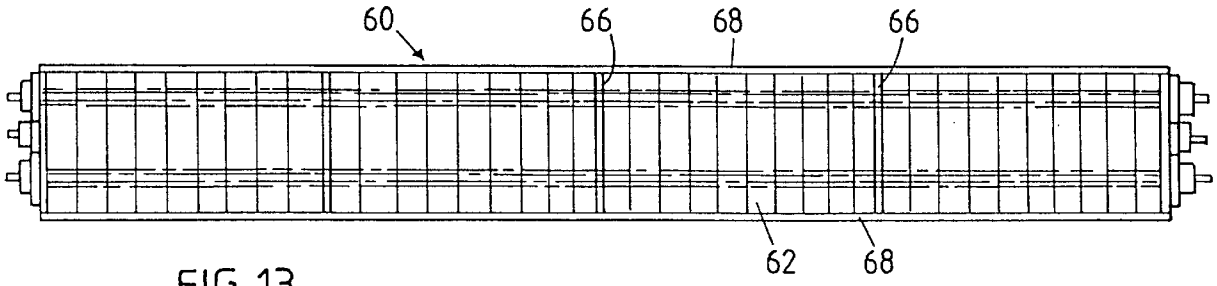
FIG. 13 is a plan view of the beam of FIG. 12.

In FIGS. 12 to 14, there is shown a structural box beam 60. Box beams can provide a relatively high load carrying capacity.

The box beam 60 comprises upper and lower, spaced flanges 62 and 64 respectively. Each flange 62 and 64 is similar to the beam 10 having a plurality of timber pieces 12 pulled together by a pre-stressing cable 14 passing through aligned holes 13. However, the flanges 62 and 64 are interconnected by a plurality of cross diaphragms 66 interposed at intervals in the longitudinal directions between timber pieces 12 and at the ends of the box beam 60. Also, the flange 64 has a spaced pair of cables 14 whilst the flange 62 has a single cable 14. It should be noted that the number of cables 14 in the flanges 62 and 64 can vary.

Further, web members 68 are located at each side of the beam 60 and fixed to the flanges 62 and 64 by any convenient means such as nails, screws or coach screws.

In use, the flanges 62 and 64 and the diaphragms 66 may be assembled first and a partial stress applied to the flanges 62 and 64, before the webs 68 are attached. After the webs 68 are attached additional stress may be applied to the top and bottom flanges 62 and 64 to the required level for use.

Bending tension and compression are accommodated by the composite action of the cables 14, the timber pieces 12 and the diaphragms 66 through which the cables 14 pass, and the webs 68.

Vertical shear is accommodated by the webs 68 whilst horizontal transfer of vertical shear from point loads on the flanges 62 and 64 can occur via friction from interfacial pressure between timber pieces 12 or fixings connecting webs 68 to the flanges 62 and 64.

The diaphragms 66 which are stressed into the flange system provide a stabilising mechanism for the box beam 60. Cross bolts (not shown) can be provided located centrally in the webs 68 and close to the diaphragms to provide anti-buckling restraints in the webs 68.

Figure 15:
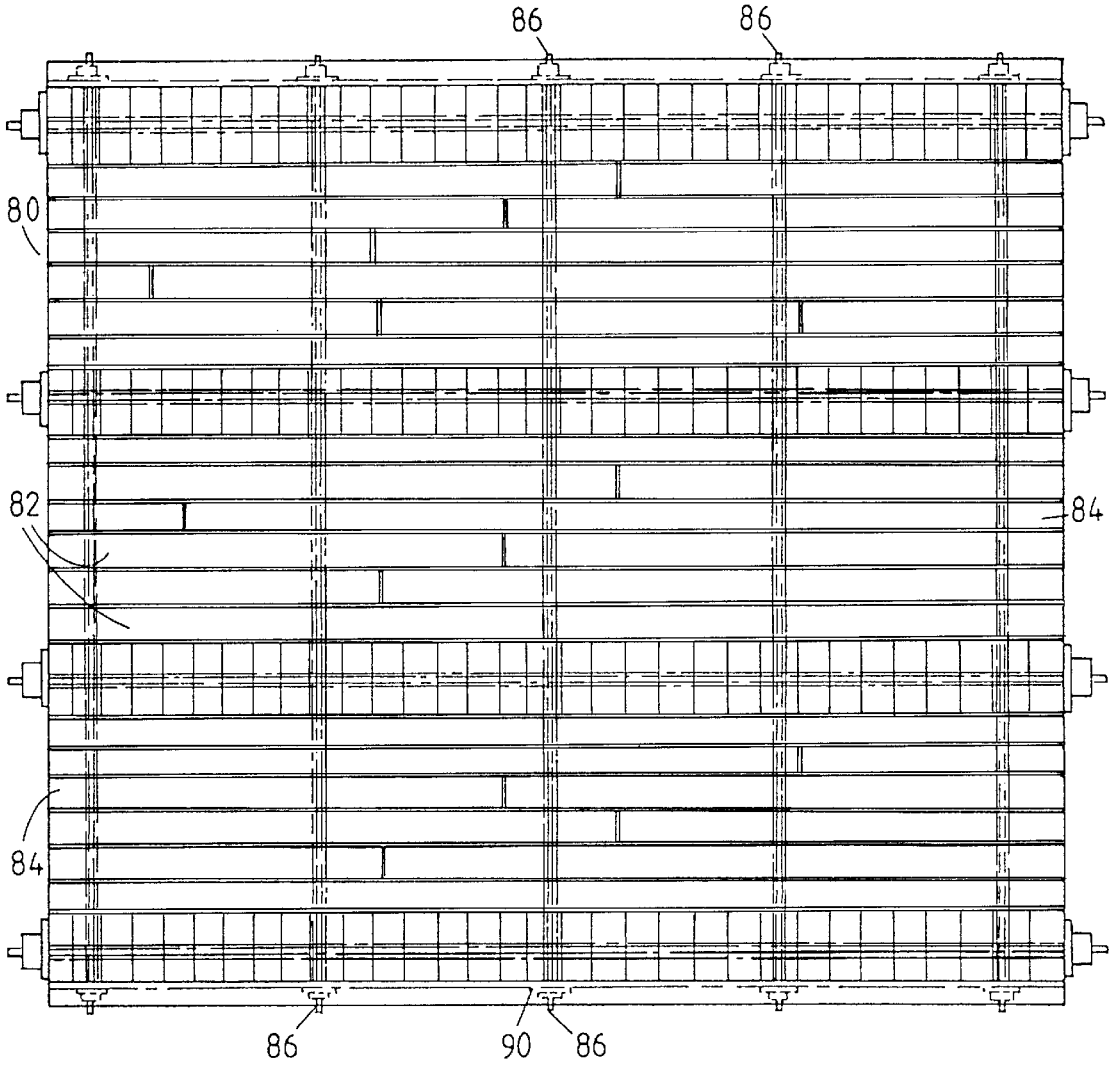
FIG. 15 is a plan view of a beam and slab construction in accordance with the present invention.
Figure 16:
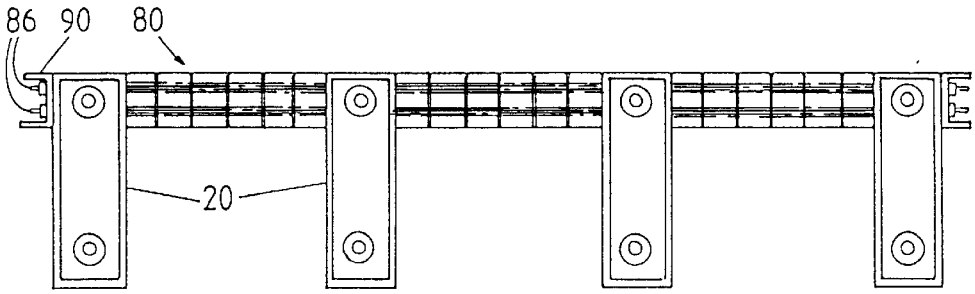
FIG. 16 is an end elevation of the construction shown in FIG. 15.

In FIGS. 15 and 16, there is shown a beam and slab construction 80. The beam and slab construction 80 uses a plurality of longitudinally extending beams 20 spaced apart and disposed parallel to one another. Between each pair of adjacent beams 20 there is disposed a plurality of random length timber pieces 82 forming slab segments 84 which extend transversely between the beams. The top surfaces of all beams 20 and slab segments 84 are at a common level.

A plurality of spaced transverse upper and lower prestressing cables 86 are passed through aligned holes drilled transversely through the beams 20 and the timber pieces 82. The cables 86 are anchored against sides of the outer beams 20 as described hereinbelow. The transverse cables 86 are located in pairs one above and one below the centreline of the slab segments 84 as can be seen in FIG. 16 to ensure composite action of the slab spanning between beams. Alternatively, cables can be located alternately above and below the slab centreline at suitable horizontal spacings to that ensure adequate prestress is maintained.

The transverse cables 86 are prestressed and cause compression between timber pieces 82 and between slabs 84 and beams 20. This enables the connection of the slabs 84 to the beams 20 and the transmission of vertical shear and the transverse bending in the slab.

The cables 86 are anchored on anchors bearing on flat bearing plates or angles or channels 90 to the outer side of the outer beams 10. The plates 90 and the like acting with the outer beams distribute anchorage forces more or less uniformly along the longitudinal edges of the slabs.

It is preferred that the timber pieces 82 have a minimum length of 2.00 times the lateral spacing of the transverse cables 86. In the construction shown in FIGS. 15 & 16 no attempt has been made to disperse or tightly close the butt joints in the longitudinal pieces 82.

Longitudinal bending capacity of the system reflects the bending capacity of the beams acting on their own.

In the event the lengths of the longitudinal pieces 82 is managed (as opposed to random selection of lengths) and end-joints in longitudinal timbers are dispersed and close-butted the compression between slabs 84 and beams 20 and between pieces 82 enables the transmission of axial or longitudinal compression in the slabs 84 from the beams 20.

In this event with the beam and slab construction of FIGS. 15 to 16, the longitudinal bending moment capacity of the system is enhanced by the axial compression capacity of the slabs (in addition to the compression zones of the beams 20). Tension capacity of the longitudinal stressing cables would be increased to match compression capacity of the system. Longitudinal bending capacity of the system would reflect the compression capacity of beams and slabs combined and the vertical separation of the compression zone and the longitudinal stressing cables of the beams 10 (providing system tension capacity).

Prestressing of beams 20 may be carried out in stages with the final stress applied after the stressing of the transverse cables in the slabs.

The bottoms of the beams may be braced, if desired, such as by metal flats, angles, pipes, or plywood sheets nailed or screwed to the bottom of the beams.

The beam and slab construction of FIGS. 15 and 16 can be used for bridge decks and building slabs.

Figure 17:
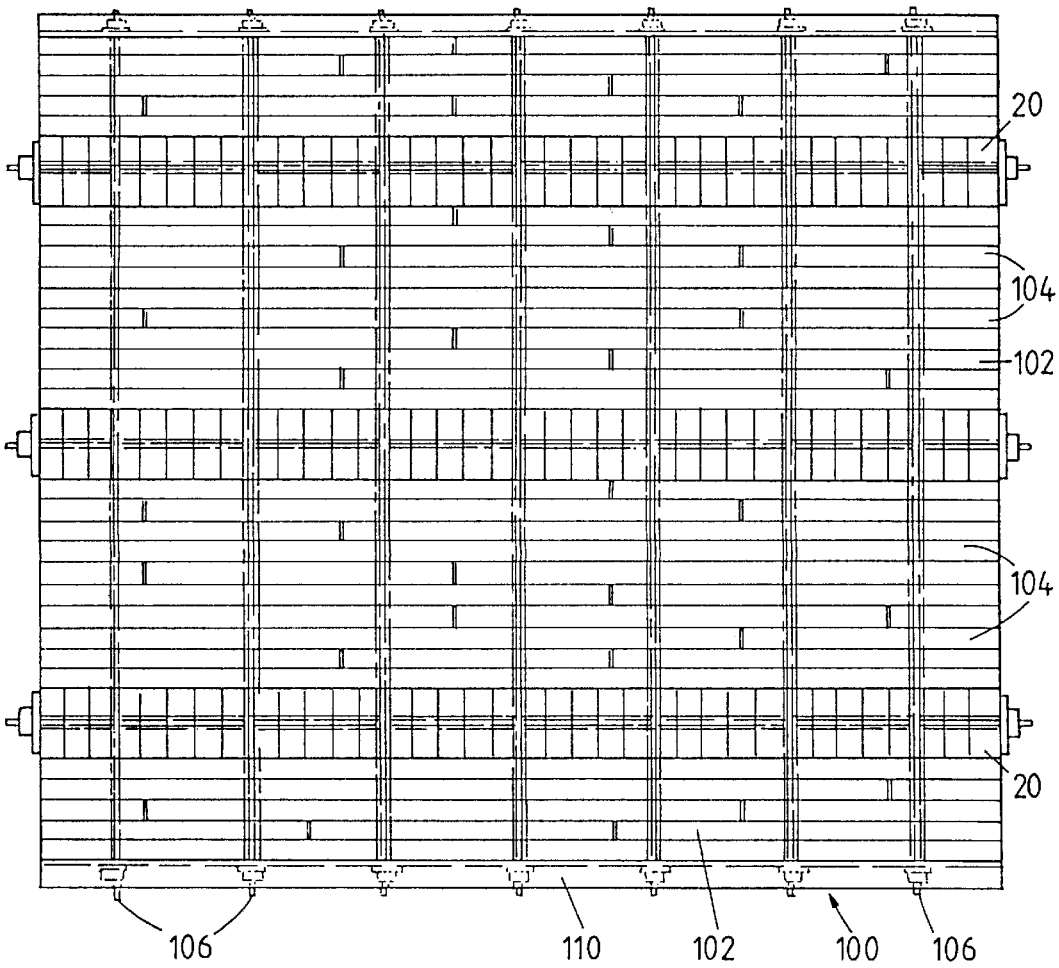
FIG. 17 is a plan view of a T-beam and slab construction in accordance with the present invention.
Figure 18:
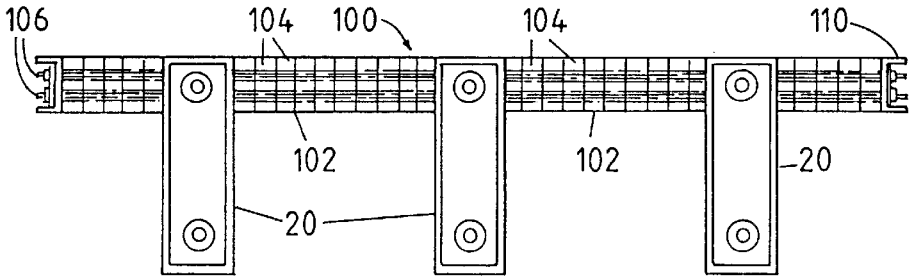
FIG. 18 is an end elevation of the construction of FIG. 17.

In FIGS. 17 and 18, there is shown a T-beam and slab construction 100 comprising a plurality of longitudinally extending parallel beams 20.

Disposed between the beams 20 and on each outer side are slab segments 102 formed of a plurality of timber pieces 104. The timber pieces 104 are of varying lengths. The slab segments 102 are held together and to the beams 20 by means of pairs of transversely extending upper and lower prestressing cables 106 passing through aligned holes in the slab segments 102 and the beams 20.

The outer slab segments 102 are located externally of the outer beams 20 and are thus cantilevered. As with the construction in FIGS. 15 and 16, the transversely extending stressing cables 106 are anchored such as on continuous channel shaped bearing plates 110.

The plates 110 may be provided with vertical web stiffener adjacent the stressing cable anchorages.

The transverse cables 106 cause compression between timber pieces 104 and between slabs 102 and beams 20. This enables the slabs to act continuously in the transverse direction in a limited way including cantilevering of the outer sections and the transverse transmission of slab shear. It also enables the connection of the slabs 102 to the beams 20.

Preferably, end-joints in longitudinal timber pieces 104 of the slab are close butted and spaced at least 1.5 metres or thereabouts in any direction so as to achieve wide dispersal of end-joints. This enables transmission of axial or longitudinal compression in the slabs 102.

With the T-Beam and slab construction of FIGS. 17 and 18, the longitudinal bending moment capacity of the system is enhanced by the axial compression capacity of the slabs (in addition to the compression zones of the beams 20) coupled with the vertical separation of the compression zones and the longitudinal stressing cables of the beams 20 (providing system tension capacity).

Prestressing of beams 20 may be carried out in stages with the final stress applied after the stressing of the transverse cables in the slabs.

It is also envisaged that a T-beam structure could have a longitudinally extending structural beam 20 with slab segments formed of timber pieces similar to the slab segments 102, disposed on each side. The slab segments are held together and to the beams 20 by means of at least one transversely extending prestressing cable passing through aligned holes in the slab segments and the beam, and the slab segments being cantilevered.

Figure 19:
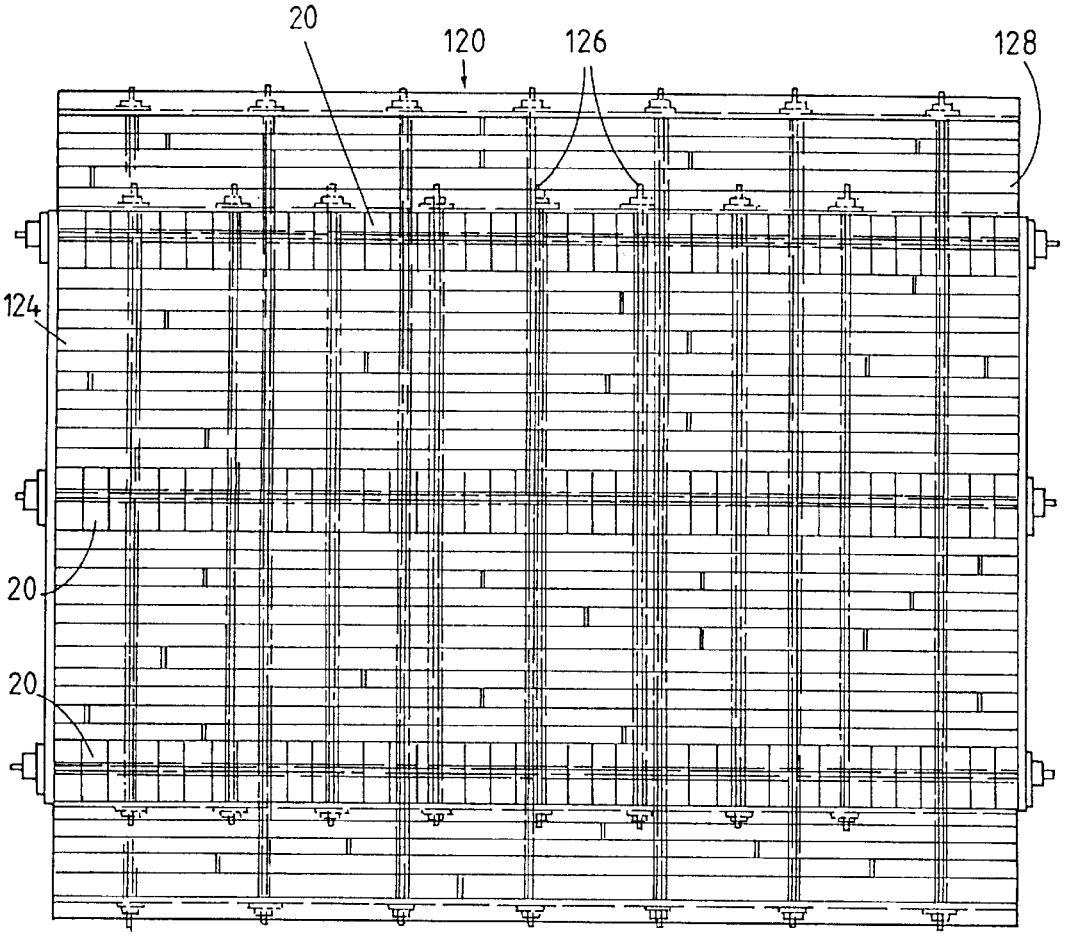
FIG. 19 is an underneath plan view of a structural box girder in accordance with the present invention.
Figure 20:
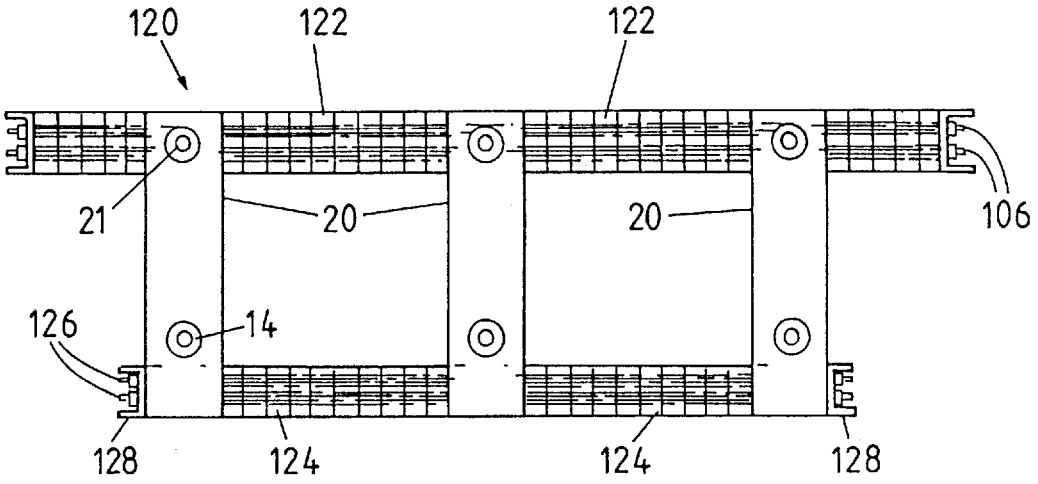
FIG. 20 is an end elevation of the box girder of FIG. 19.

In FIGS. 19 and 20, there is shown a structural box girder 120 comprising a plurality of spaced, parallel, longitudinally extending beams 20. The box girder 120 also comprises upper slab segments 122 which are similar to the slab segments 102 of FIGS. 17 and 18. However, the eccentricity of the cables 14 in the beams 20 is reduced to accommodate transverse cables (see FIG. 20) as will be described. There are also lower slab segments 124 which interconnect transversely lower ends of the beams 20.

The upper slab segments 122 are primarily in compression whilst the lower slab segments 124 are in tension.

The lower slab segments 124 have a plurality of pairs of transversely extending stressing cables 126 mounted against bearing plate channels 128 and which extend below the cables 14 as shown in FIG. 20. The lower slab segments 124 are similar to the upper slab segments 122 except that there are no cantilever portions. Joints in the lower slab segments 124 are preferably suitably spaced to accommodate a reasonable amount of tension.

In this construction, principal bending tension is accommodated in the longitudinal direction by stressing cables in direct tension and the lower slab segments 124. Principal bending compression in the longitudinal direction is accommodated by the upper slab segments 122 and the beams 20.

The longitudinal bending moment capacity of the system is enhanced by vertical separation of the upper slab 124 segments from the cables 14 and the lower slab segments 124.

The lower slab stressed cables 126 result in a shear connection of the lower slab segments 124 to the beams 20, The timber pieces in the slab segments 124 transmit axial force from the beams 20 and from one another and well separated butt joints in the timber pieces are acceptable because stress redistribution is achievable because of interface pressure.

Figure 21:
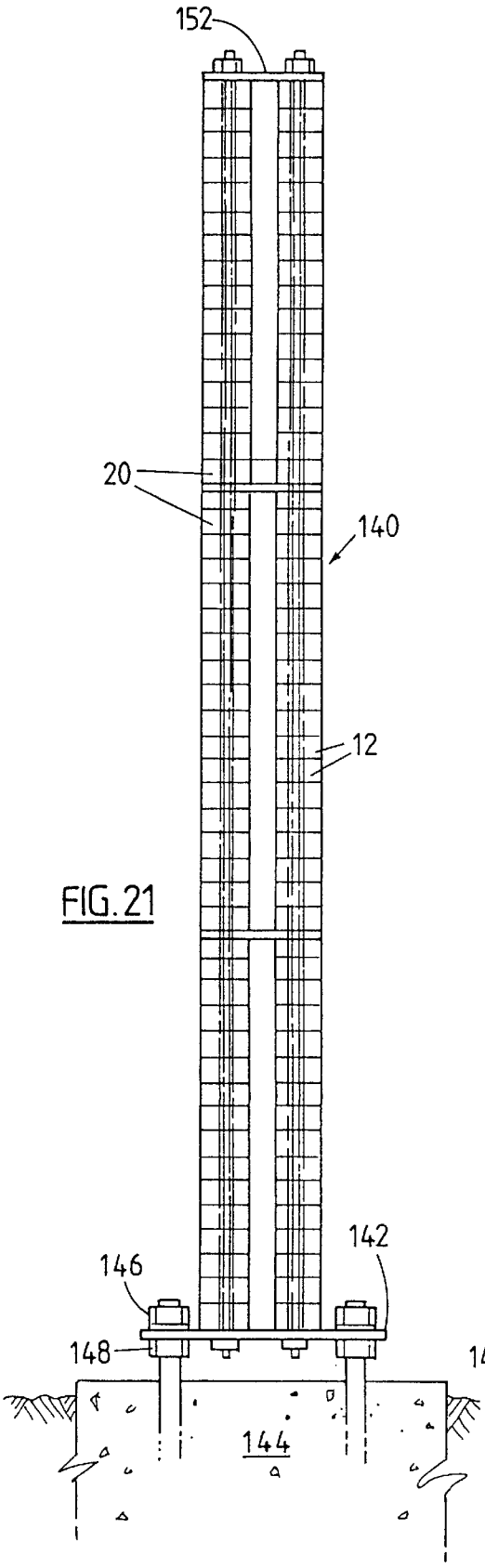
FIG. 21 is a section along the line B of FIG. 23 of a pole in accordance with the present invention.
Figure 22:
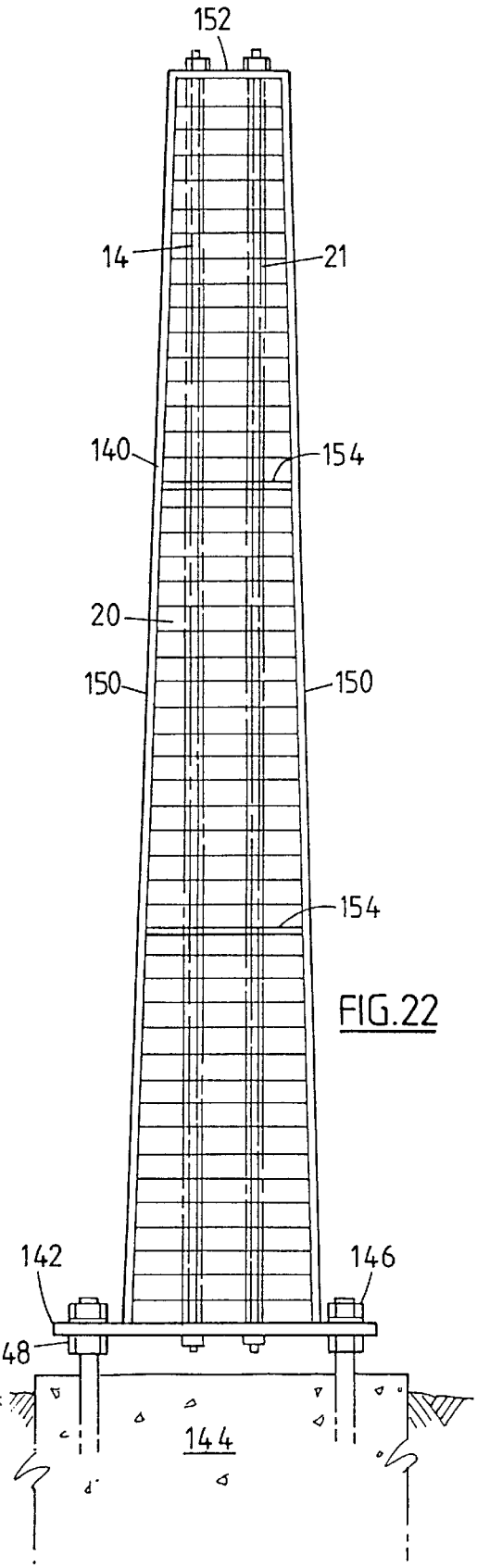
FIG. 22 is a side elevation of the pole of FIG. 21 viewed from A of FIG. 23.
Figure 23:
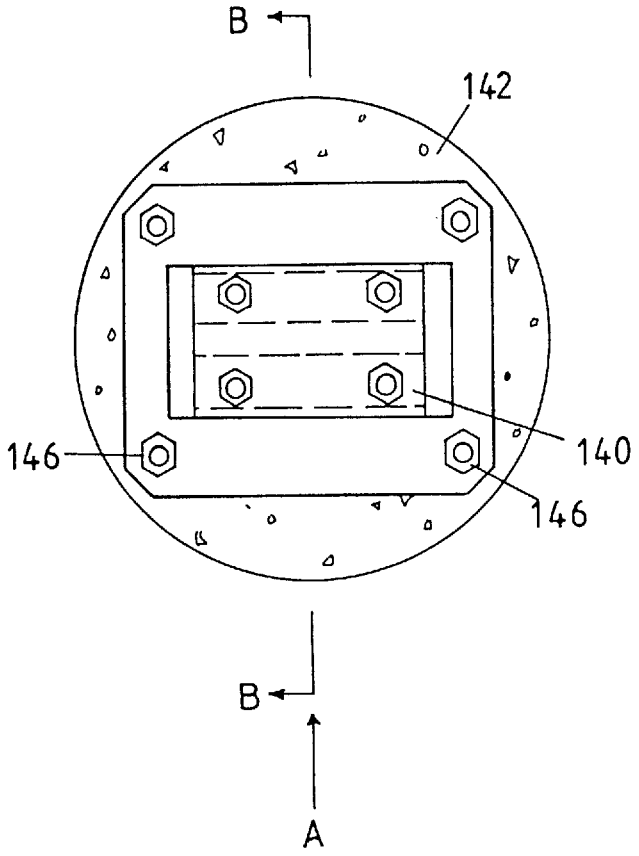
FIG. 23 is a plan view of the pole of FIG. 21 in accordance with the present invention.

In FIGS. 21 to 23, there is shown a pole 140 such as a light pole, power pole or flag pole, The pole 140 comprises a metal base plate 142 secured to a concrete pile 144 by means of anchor bolts 146 which include a levelling locknut 148.

The pole 140 comprises a pair of sloping faces 150 which may be formed of cladding material such as plywood. Thus, the pole 140 has a trapezoidal appearance from the side and a rectangular appearance from the front. Further, between the faces 150 are disposed a pair of beams 20. The beams 20 comprise a plurality of timber pieces 12 located between the base plate 142 and a metal top plate 152 and stressed by two pairs of cables 14 and 21 anchored on the plates 142 and 152 and extending through aligned holes in the timber pieces 12. The timber pieces have ends which are tapered appropriately to fit within the slopping faces 150.

The pole 140 may contain one or more diaphragms 154 formed of, for example, plywood inserted between adjacent timber pieces at intervals.

In the directions of the timber pieces, bending and axial tension and compression are accommodated by the composite action of wood, plywood and prestressed steel cables. Horizontal shear is transmitted by friction induced by the prestress in the pole. Horizontal torsion is accommodated by the box structure of the faces 150 connected to the timber pieces 12 transmitted vertically by friction between timber pieces 12 by prestress and the shear strength of plywood.

The timber pieces used in the present invention may be offcuts from sawmilling or plywood manufacture or particle board manufacture, or derivatives of other reconstituted wood products.

Modifications and variations such as would be apparent to a skilled addressee are deemed within the scope of the present invention. For example, the timber pieces could be replaced by appropriately shaped plastics material pieces.

I claim:

1. A structural box girder including at least two structural beams disposed parallel to one another and upper and lower slab segments interconnecting the beams, each structural beam including a plurality of transversely extending discrete timber pieces arranged in alignment, each timber piece having opposed transversely extending parallel faces which abut with the parallel faces of adjacent pieces, a respective bearing plate being located at each end of each beam, an aperture being formed in each timber piece such that respective apertures in each beam are aligned, and a longitudinally extending prestressing cable extending through the aligned apertures and being anchored on the bearing plates under tension so as to press the aligned timber pieces together with the transversely extending parallel faces in abutting relation with the parallel faces of adjacent timber pieces, each slab segment also having a plurality of discrete timber pieces extending transversely to the timber pieces of the structural beams, each timber piece of each slab segment having opposed parallel faces which abut with the parallel faces of adjacent timber pieces, a respective bearing plate being located at each end of each slab segment, an aperture being formed in each timber piece of each slab segment such that the apertures in each slab segment are aligned, respective prestressing cables extending through the aligned apertures in each slab segment and being anchored on the bearing plates of the segments under tension so as to press the timber pieces together so that the parallel faces of adjacent timber pieces of the slab segments are in abutting relation, the prestressing cables in the slab segments extending orthogonally to the prestressing cables in the beams, the beams and the upper slab segment forming a flat upper surface.

2. The structural box girder according to claim 1, wherein, the timber pieces of the beams each include a second aperture spaced from the aperture such that second apertures in the beam are aligned, and at least two longitudinally extending prestressing cables extend the aligned apertures, the prestressing cables are spaced apart from one another vertically.

3. The structural box girder according to claim 1, wherein, timber pieces of the segments each include a second aperture spaced from the aperture such that second apertures in the segments are aligned and at least two prestressing cables extend through the aligned apertures, the prestressing cables are spaced apart from one another vertically.

4. The structural box girder according to claim 1, wherein the upper slab segment has a cantilever portion extending outwardly from the beams.

5. The structural box girder according to claim 2, wherein each beam has a lowermost prestressing cable which is disposed above the lower slab segment, but below the level of the upper slab segment.

6. The structural box girder according to claim 1, wherein, in each of the beams, the timber pieces have a timber grain, and are disposed with the timber grain extending transversely relative to the bearing plates on the ends of the beams.

7. The structural box girder according to claim 1, in which at least some of the apertures containing pre-stressing cables are grouted.

* * * * *